United States Patent [19]

Baechler

[11] Patent Number: 4,753,152

[45] Date of Patent: Jun. 28, 1988

[54] ARRANGEMENT FOR BRAKING A SABOT

[75] Inventor: Theodor Baechler, Marklkofen-Warth, Fed. Rep. of Germany

[73] Assignee: Messerschmitt-Bölkow-Blohm GmbH, Fed. Rep. of Germany

[21] Appl. No.: 749,003

[22] Filed: Jun. 25, 1985

[30] Foreign Application Priority Data

Jul. 4, 1984 [DE] Fed. Rep. of Germany ..... 3424597

[51] Int. Cl.[4] ..... F41F 17/12

[52] U.S. Cl. ..... 89/1.701; 89/14.6; 188/371; 188/374

[58] Field of Search ..... 89/14.6, 1.701; 102/520, 521, 522, 523; 42/76 R; 188/371, 374

[56] References Cited

U.S. PATENT DOCUMENTS

| | | | |
|---|---|---|---|
| 868,938 | 10/1907 | Puff | 89/14.6 |
| 3,619,924 | 11/1971 | Paine | 89/14.6 |
| 3,762,279 | 10/1973 | Zeyher | 188/371 |
| 4,132,148 | 1/1979 | Meistring et al. | 89/1.701 |
| 4,148,244 | 4/1979 | Schnabele et al. | 89/1.701 |

*Primary Examiner*—Deborah L. Kyle
*Assistant Examiner*—Michael J. Carone
*Attorney, Agent, or Firm*—McGlew and Tuttle

[57] ABSTRACT

To brake a sabot accelerated in a launcher of a recoiless rifle tube a mandrel shaped braking sleeve is disposed in the tube and an intermediate space is provided between a tapered surface of the mandrel and the tube into which the material of the front edge of the sabot expanded. In this way when the sabot is accelerated against the mandrel, its front edge slides along the tapered surface, radially outwardly into the intermediate space. This functions to deform and positively stop the movement of the sabot before it leaves the tube.

15 Claims, 2 Drawing Sheets

ARRANGEMENT FOR BRAKING A SABOT

FIELD AND BACKGROUND OF THE INVENTION

The present invention relates in general to recoiless weapons and in particular to a new and useful arrangement for braking the movement of a sabot in a launching tube.

The tubes of weapons which are provided with an acceleratable sabot become sealed at their end by the stopped sabot so that flame generated in the tube are prevented from flashing to the outside and a report is suppressed. The absence of a recoil is due to the provision of two sabots which are accelerated in opposite directions, namely a sabot propelling the projectile and a sabot expelling the countermass.

Arrangements of this kind are known for example from German Pat. Nos. 21 15 770 and 26 51 167, and from German utility model No. 81 20 209. The energy of the sabot is absorbed by a plastic deformation of the braking sleeve. For this purpose, a braking sleeve having an constant wall thickness is bevelled to form a wedge-shaped intermediate space into which the front edge of the sabot penetrates, whereupon, starting with the beveled portion, the braking sleeve is deformed inwardly, into the concavity of the sabot.

In this prior art design, however, cracks and slide fractures in the relatively thin braking sleeve experiencing considerable deformation must be expected at the high speeds experience (exceeding 200 m/s), so that the sabot is not quite securely prevented from being ejected from the tube. This results in an insufficient sealing, and an unsatisfactory safety for the gunner at the rearward zone of the launching tube.

The risk of ejecting a sabot of the prior art design is still more significant if the speed of the projectile (and also of the sabot) is further augmented to increase range or hitting accuracy.

SUMMARY OF THE INVENTION

The present invention is directed to an arrangement for preventing the sabot from being ejected from the tube, thus providing a sealed firing as well as safety to the operator and toward the rear of the tube even at very high speeds.

Accordingly an object of the present invention is to provide in combination with a launching tube having a bore and an open end, an arrangement for braking a sabot comprising a braking sleeve near the open end of the tube against which the sabot is accelerated, the braking sleeve being formed as a mandrel having an outwardly tapering surface defining an intermediate space with the tube, the sabot having an outwardly tapering front end movable against the mandrel and along the tapering surface into the space.

A further object of the invention is to provide an arrangement for braking a sabot which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

In the following, one embodiment of the invention is explained in more detail with reference to the drawings in which:

FIG. 1 is a diagrammatical vertical sectional view of one end of a launching tube, showing a braking sleeve, a projectile and a sabot; and FIG. 2 is an enlarged detail showing the front edge of the sabot, and FIG. 3 is a partial view similar to FIG. 1 showing the expansion of the sabot.

DESCRIPTION OF THE PREFERRED EMBODIMENT

Figure 1:
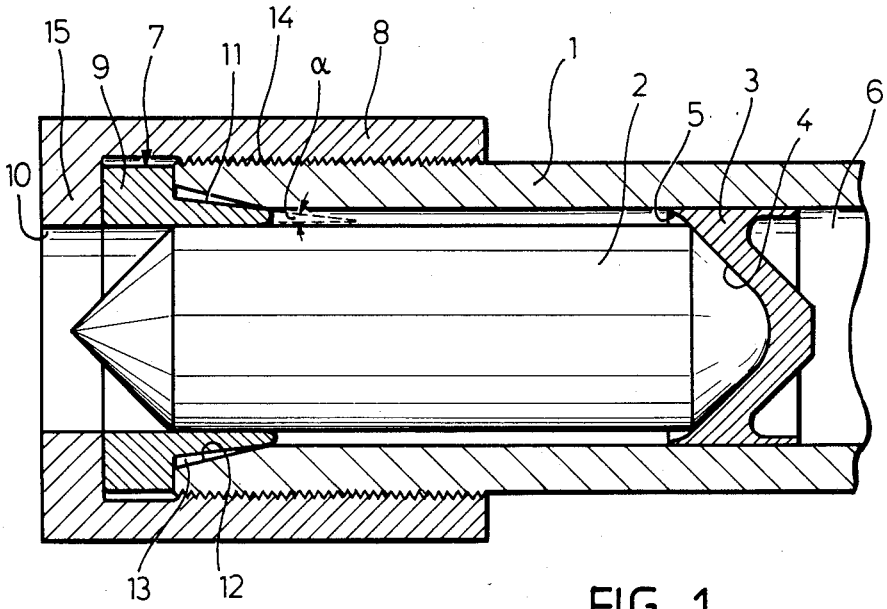

According to FIG. 1, a launching tube 1 in a position ready for firing accommodates a projectile 2 and a sabot 3. Sabot 3 is shaped with a flaring concavity 4 so that an acute rim or front edge 5 thereof is formed. The sabot seals one side of a gastight working space 6 to be pressurized with gases and smoke from the propellant charge to be ignited.

At the front end remote from sabot 3 of launching tube 1, a braking sleeve 7 is provided which is fixed to the tube with a cap screw 8.

Braking sleeve 7 comprises a flange 9 on its end remote from sabot 3, thus close to the muzzle 10, and a mandrel portion having a tapered surface 11.

Launching tube 1 comprises, also at its end close to muzzle 10, thus in the zone of tapered surface 11, a portion 12 which flares from the tube caliber outwardly, toward the tube end. In this way, an intermediate space 13 is formed between tapered surface 11 and flaring tube portion 12.

Flange 9 of braking sleeve 7 is pressed by cap screw 8 firmly against the adjacent front face of tube 1. To this end, the tube is provided with an external thread, and capscrew 8 is designed with an inner thread and with a ring shoulder 15 applying against flange 9 of sleeve 7.

The acute front edge 5 of the sabot and the rear edge of the braking sleeve are advantageously truncated to a width of a fraction of 1 mm.

The arrangement operates as follows:

Upon igniting the propellant charge (not shown), sabot 3 is made of an easily deformable metal such as aluminum or an aluminum alloy, is accelerated in the tube end direction by the powder vapors of the charge, produced in the working space 6. As sabot 3 impinges on braking sleeve 7, the acute front edge 5 of the sabot starts running up the tapered surface 11 of the sleeve. The projectile 2, accelerated by sabot 3, moves at the same time unobstructed through braking sleeve 7 out of the tube.

On further motion, the front edge 5 of the sabot becomes expanded outwardly by the tapered mandrel surface 11 and the material of this edge 5 flows into the intermediate space 13 between surface 11 and the enlarged portion 12 of the tube.

While the front edge 5 of the sabot is outwardly expanded, the braking sleeve 7 which is made of a hard material, such as steel is pressed inwardly. However, only tapered surface 11 and the outer edge of flange 9 facing the front face of tube 1 are displaced inwardly, while the face turned to ring shoulder 15 of flange 9 substantially remains applied to shoulder 15. Flange 9 thus forms a reinforcement of braking sleeve 7 and the result obtained is that the deformations occurring in the zone of tapering surface 11 of sleeve 7, even though they make the sleeve wavy, do not lead to cracks or slide fractures.

Figure 2:
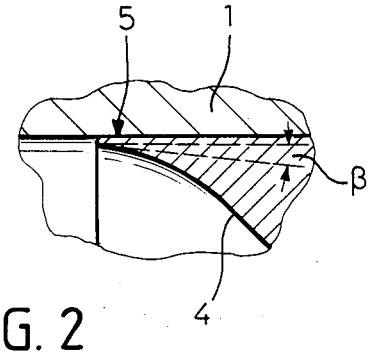
Figure 3:
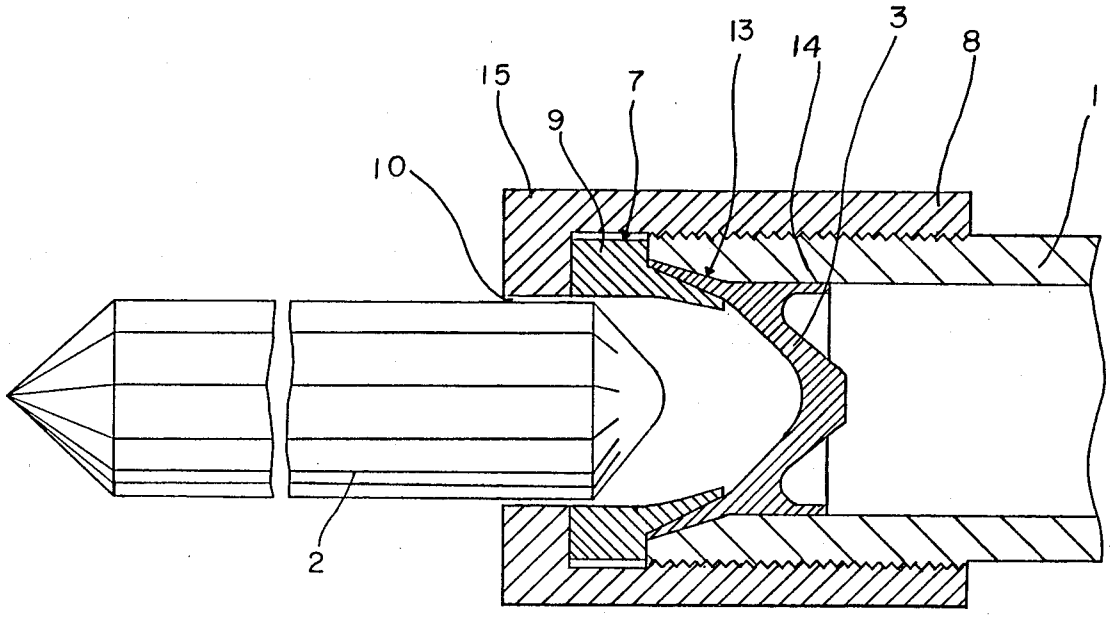

Experience has shown that the taper angle $\alpha$ of mandrel surface 11, and angle $\beta$ shown in FIG. 2 and formed between the tangent to the acute front edge 5 of the sabot and the inside of the tube, are of importance to the invention. It has been found, for example, that with an angle $\beta$ of more than 30°, it may happen that front edge 5 of the sabot presses the sleeve 7 in the zone of surface 11 inwardly before projectile 2 has completely passed this zone, so that the projectile bottom, or an intermediate member if provided, is sheared off. Even the front edge zone of sabot 3 might be sheared off in such an instance, so that the central portion of sabot 3 may be ejected through sleeve 7.

In tests with the inventive arrangement, sabots having speeds of about 315 m/s were stopped. The range and hitting accuracy, for example, of antitank weapons can thereby be considerably augmented.

The mandrel surface having a tapering surface 11 which makes an angle with the access of the bore of the launching tube which is at most 20°. Some instances it is preferrable if the tapering surface is maintained below 15°. The acute angle of the outwardly expanded front edge 4 of the sabot is at most 35°. And in some instances it is preferrable to keep it below 25°.

While a specific embodiment of the invention has been shown and described in detail to illustrate the application of the principles of the invention, it will be understood that the invention may be embodied otherwise without departing from such principles.

What is claimed is:

1. A recoilless weapon with a launching tube having a bore and a projectile ejecting end communicating with said bore, an arrangement for braking a sabot accelerated in the tube toward the ejecting end so that the sabot remains in the tube comprising a sabot disposed in said bore and having a pointed front edge which makes a first acute angle with said bore, a braking sleeve of a material harder than said sabot fixed to said tube adjacent said ejecting end, said braking sleeve comprising a mandrel having an outwardly tapering surface, said tube having a large diameter portion facing said tapering surface and defining with said tapering surface an intermediate space, whereby when said sabot is accelerated toward said mandrel said pointed edge of said sabot engages with and expands along said tapering surface of said mandrel and moves into an intermediate space for braking the movement of said sabot before said sabot leaves said projectile ejecting end of said tube.

2. The combination of claim 1, wherein said large diameter portion of said tube is formed by an outwardly flaring surface of said tube communicating with said bore and of a larger diameter than said bore extending toward said ejecting end of said tube.

3. The combination of claim 1, wherein said mandrel includes a flange, said tube having a front face adjacent said ejecting end thereof, said flange lying against said front face of said tube.

4. The combination of claim 3, including a screw cap threaded onto said tube having a shoulder engaged against said flange of said mandrel for retaining said mandrel on said tube.

5. The combination of claim 1, wherein said first acute angle for said outwardly expanded front end of said sabot is at most 35°.

6. The combination of claim 5, wherein said first acute angle of said outwardly expanding front end of said sabot is at most 25°.

7. The combination of claim 1, wherein said mandrel is made of harder material than said sabot.

8. The combination of claim 7, wherein said acute angle of of said tapering surface is at most 15°.

9. The combination of claim 7, wherein said mandrel is made of steel.

10. The combination of claim 9, wherein said sabot is made of aluminum.

11. The combination of claim 9, wherein said sabot is made of aluminum alloy.

12. The combination of claim 7, wherein said sabot is made of aluminum.

13. The combination of claim 7, wherein said sabot is made of aluminum alloy.

14. The combination of claim 1, wherein said mandrel tapering surface has a taper angle which makes an angle with the axis of said launching tube bore of no more than 20°.

15. An arrangement for braking a concave sabot by plastic deformation, which is driven through a tube in a recoilless weapon so that the sabot remains in the tube, comprising: a braking sleeve which is provided in a zone of the tube portion which the sabot is accelerated, and is secured to the tube and thus prevented from being ejected from the tube, the sleeve forming with the tube an intermediate space into which an acute front edge of the concave sabot penetrates as the sabot moves thereagainst, the braking sleeve being designed as a mandrel by which the front edge of the sabot is expanded outwardly as the sabot moves along the sleeve, with an intermediate space for receiving the outwardly expanded front edge of the sabot being formed by a tapering surface of the mandrel and a larger diameter portion of the tube.

* * * * *